US005624113A

United States Patent [19]

Rabine

[11] Patent Number: 5,624,113

[45] Date of Patent: Apr. 29, 1997

[54] PORTABLE BATTING SYSTEM

[76] Inventor: Matthew S. Rabine, 6448 W. Colter St., Glendale, Ariz. 85301

[21] Appl. No.: 544,175

[22] Filed: Oct. 17, 1995

[51] Int. Cl.[6] ..... A63B 69/40

[52] U.S. Cl. ..... 473/430

[58] Field of Search ..... 273/29 A, 26 E, 273/58 C; 482/83, 88, 89, 90

[56] References Cited

U.S. PATENT DOCUMENTS

| | | | |
|---|---|---|---|
| 1,753,309 | 4/1930 | Costello | 482/88 |
| 1,753,310 | 4/1930 | Costello | 482/88 |
| 3,542,364 | 11/1970 | Gaumond | 482/88 |
| 3,652,088 | 3/1972 | Marsh | 273/26 E |
| 3,904,199 | 9/1975 | Burchett | 273/29 A |
| 4,138,107 | 2/1979 | Janis | 273/29 A |
| 4,350,338 | 9/1982 | May | 273/58 C |
| 4,793,612 | 12/1988 | Hammond | 273/58 C |
| 5,000,450 | 3/1991 | Beintema | 273/26 E |
| 5,246,226 | 9/1993 | McGuinn | 273/26 E |
| 5,282,615 | 2/1994 | Green et al. | 273/26 E |
| 5,340,101 | 8/1994 | Lawson et al. | 273/26 |
| 5,460,364 | 10/1995 | Ring | 273/29 A |

*Primary Examiner*—Theatrice Brown
*Attorney, Agent, or Firm*—Patent & Trademark Services; Joseph H. McGlynn

[57] ABSTRACT

A batting practice system having a base flange which can be attached to a chain link fence or a support pole. Attached to the flange is a horizontal support member with a tip at the end to which is attached a rope with a ball on the end. The base flange also has apertures to which resilient cords, such as "bungee" cords may be attached to stabilize the base.

3 Claims, 1 Drawing Sheet

PORTABLE BATTING SYSTEM

BACKGROUND OF THE INVENTION

This invention relates, in general, to a baseball or softball batting practice device, and, in particular, to a batting practice device that is portable and can easily be assembled and disassembled.

DESCRIPTION OF THE PRIOR ART

In the prior art various types of practice devices have been proposed. For example, U.S. Pat. No. 3,652,088 discloses a batting practice device which has a rope trackway along which a pulley carriage travels. A simulated baseball or softball is suspended from the carriage by a nylon cord and as the batter strikes the ball it and the carriage travels along the rope trackway. U.S. Pat. No. 4,138,107 discloses a practice device for tennis in which a pair of guide rails are attached to the floor and the ceiling. A ball is secured to the guides by elastic cords, and when it is hit moves along the guides. U.S. Pat. No. 5,000,450 discloses a batting practice device which has an elongated support arm for securing the device to the side of a post. U.S. Pat. No. 5,246,226 discloses an L-shaped batting tee which supports a ball attached to a cord. U.S. Pat. No. 5,282,615 discloses a tethered ball hitting practice apparatus which includes a stand which suspends a pair of balls from each side so a pair of batters may practice at the same time. U.S. Pat. No. 5,340,101 discloses a batting practice apparatus which has a frame work which can be attached to a chain link fence. A ball is suspended from the frame work by a pair of elastic cords.

However, all of the prior art devices suffer from major drawbacks. They are either complicate to set up, or require a special location, or they are not sturdy enough to be used by the stronger players. The present invention requires no special location to be set up, has a simple mounting system and is strong enough to be used even by adults.

SUMMARY OF THE INVENTION

The present invention consists of a base flange which can be attached to a chain link fence or a support pole. Attached to the flange is a horizontal support member with a tip at the end to which is attached a rope with a ball on the end. The base flange also has apertures to which resilient cords, such as "bungee" cords may be attached to stabilize the base.

It is an object of the present invention to provide a batting practice system which is of simple and inexpensive construction.

It is an object of the present invention to provide a batting practice system which can be set up in various locations.

It is an object of the present invention to provide a batting practice system which is sturdy enough so even an adult may use it.

These and other objects and advantages of the present invention will be fully apparent from the following description, when taken in connection with the annexed drawings.

DESCRIPTION OF THE PREFERRED EMBODIMENT

Figure 1:
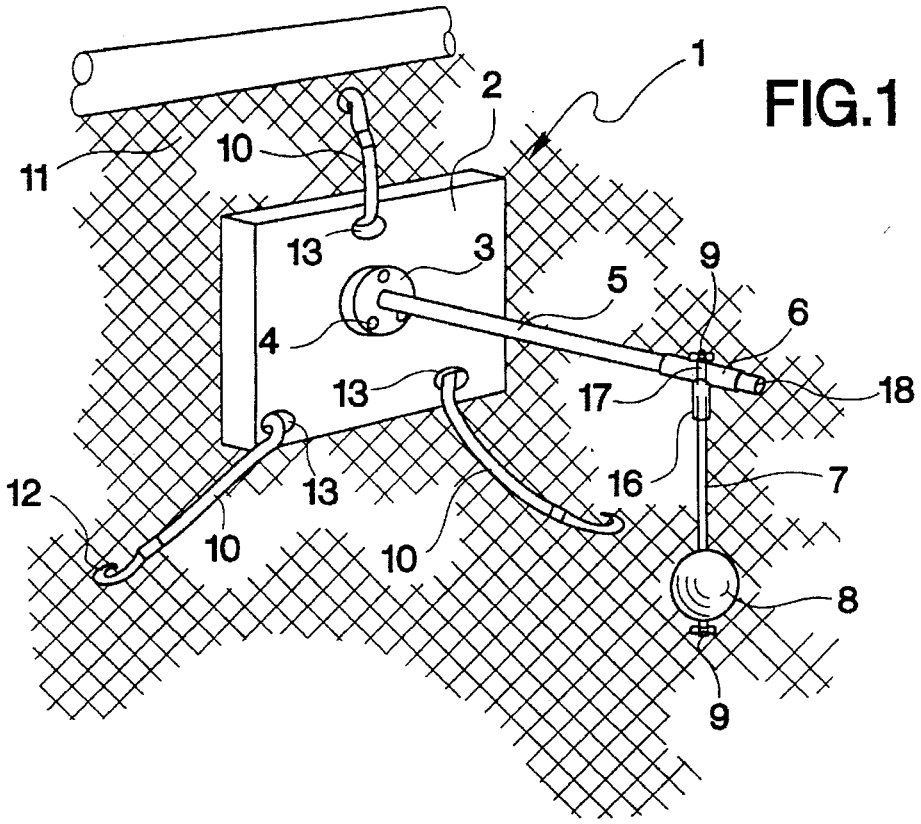
FIG. 1 is a perspective view of the present invention.

Referring now to the drawings in greater detail, FIG. 1 shows the batting practice system 1 of the present invention. It consists of a base 2 made from, but not limited to, plastic. A flange 3 with a center aperture 14 having internal threads is fastened to the base 2 by bolts 15 extending through apertures 4 in the flange. A pipe 5 having external threads on one end is fastened to the aperture 14. At the opposite end the pipe has a tee-fitting 6. The fitting 6 could have internal threads which cooperate with external threads on the pipe 5 to secure the fitting on the pipe.

Figure 3:
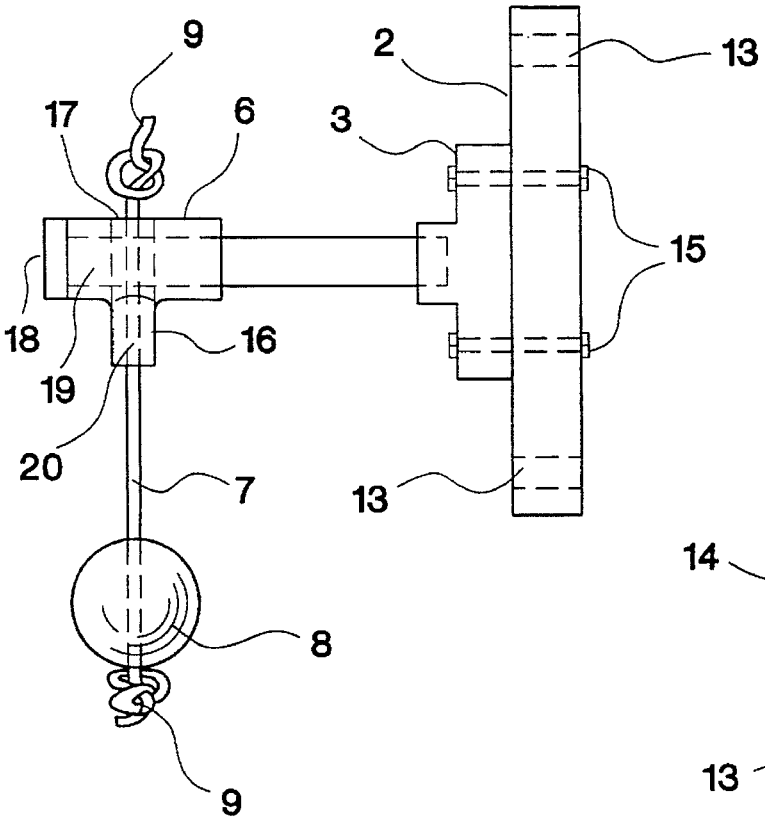
FIG. 3 is a side view of the present invention.
Figure 2:
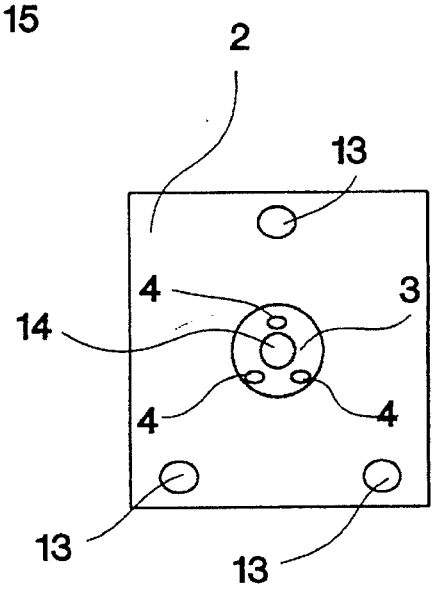
FIG. 2 is a plan view of the base of the present invention.

The tee-fitting has a horizontal portion to which is integrally attached a vertical portion 16. The horizontal portion has an aperture 19 and the vertical portion has an aperture 20 extending therethrough, as shown in FIG. 3. An end cap 18 may be frictionally attached to the end of the tee-fitting. A rope 7 is passed through the vertical portion 16 and through an aperture 17 in the top of the fitting. The rope can be knotted at 9 to prevent the rope from coming back through the fitting. At the other end of the rope a ball 8 is attached by passing the rope through an aperture in the ball and knotting the end as shown in FIG. 3 at 9.

Extending through the base 2 are three holes 13. Hooks 12 on one end of the resilient cords 10, commonly known as "bungee cords", are secured in each of the apertures 13. Hooks on the other end of the bungee cords are then secured to a chain link fence 11, as shown in FIG. 1. The bungee cords, because of their resiliency will provide a secure mounting of the base to the fence and will absorb any forces on the base 2 when the ball 8 is hit.

The cords 10 also allow the batting practice system to be set up and taken down quickly. All that is necessary is to hold the base with one hand, hook one end of the bungee cord through an aperture 13, and then stretch the cord until it is taunt and hook the other end through the chain link fence 11. This process is then repeated for the other two cords and the base will be securely mounted to the fence and ready for use.

The pipe 5, the flange 3, and the tee-fitting 6 could also be made from plastic. In this case the threads on the pipe, flange and tee-fitting could be eliminated. The plastic elements could be secured together by friction or conventional plastic pipe glue.

In order to use the batting practice system the base 2 is first secured to a chain link fence, as described above, then the pipe 5 is attached to the flange 3. The tee-fitting, with the ball 8 already attached, is secured to the pipe and then a batter may practice his awing by hitting the ball 8. The force of the ball being hit with a bat will be absorbed by the bungee cords, thus preventing any damage to the batting practice device.

Although the batting practice system and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A batting practice system, comprising a base having means for attaching a horizontal element to said base, said horizontal element having a member with a vertical portion attached thereto, said vertical portion being hollow and attached to said horizontal portion at substantially a right angle, a flexible element passing completely through said vertical portion and said horizontal portion, and a ball attached to one end of said flexible element, said base having means for securing resilient bands thereto, and resilient bands secured to said base at one end and secured to a support at an opposite end.

2. The batting practice system as claimed in claim 1, wherein said means for attaching a horizontal element to said base is a relatively flat plate with a central aperture therethrough, said horizontal element being secured within said central aperture.

3. The batting practice system as claimed in claim 1, wherein said means for securing resilient bands to said base is three apertures extending through said base.

* * * * *